United States Patent [19]

Grise et al.

[11] Patent Number: 4,849,255

[45] Date of Patent: Jul. 18, 1989

[54] ELECTRIC RESISTANCE HEATER

[76] Inventors: Frederick G. J. Grise, 137 East Bay Rd., Osterville, Mass. 02655; John A. Martstiller, 86 Cardinal La., Marston Mills, Mass. 02648; Paul H. Bodensiek, 6 Sutherland Rd., #41, Brighton, Mass. 02135

[21] Appl. No.: 72,921

[22] Filed: Jul. 14, 1987

[51] Int. Cl.[4] ..... B05D 5/12

[52] U.S. Cl. ..... 427/122; 427/123; 427/125; 219/543

[58] Field of Search ..... 219/543; 427/122, 123, 427/125

[56] References Cited

U.S. PATENT DOCUMENTS 4,429,216. 1/1984 Brigham ..... 219/543
4,523,085 6/1985 Grise ..... 219/543
4,528,546 6/1985 Paoli ..... 219/543
4,584,553 4/1986 Tokurg ..... 219/543
4,591,701 5/1986 Tokumaru ..... 219/543

*Primary Examiner*—Sam Silverberg

[57] ABSTRACT

An electrical heater including a semi-conductor pattern (e.g., colloidal graphite ink) printed on a substrate. A conductive ink (e.g., a silver ink) is dposited on the semi-conductor pattern. The conductive ink migrates into the semi-conductor material, provides a superior electrical contact between the conductor (e.g., the silver ink) and the underlying semi-conductor material (e.g., the semi-conductor graphite ink), and essentially eliminates interface resistance. In some embodiments, the semi-conductor pattern is printed on one side of a woven cloth substrate and the conductive ink is printed on the other side.

8 Claims, 2 Drawing Sheets

ELECTRIC RESISTANCE HEATER

FIELD OF THE INVENTION

This invention relates to electric resistance heaters and, more particularly, to heaters including a semi-conductive pattern carried on an electrically insulating substrate.

BACKGROUND OF THE INVENTION

U.S. Pat. Nos. 4,485,297 issued Nov. 27, 1984, 4,523,085 issued June 11, 1985, and 4,542,285 issued Sept. 17, 1985, and U.S. Pat. applications Ser. Nos. 478,080 filed Mar. 23, 1983, now abandoned, and 796,012 filed Nov. 7, 1985, all of which are incorporated herein by reference, disclose electrical heaters of the type including a paper or plastic substrate on which is printed a semiconductor pattern (typically a colloidal graphite ink) having (a) a pair of conductor contact portions extending parallel to each other and (b) a heating portion (typically a plurality of transverse bars) extending between and electrically connected to the conductor contact portions. A metallic conductor (typically copper stripping) overlies each of the conductor contact portions, and an overlying sealing layer is bonded to the substrate closely adjacent the opposite edges of the conductor and holds the conductor in tight face-to-face engagement therewith with the underlying conductor contact pistons.

Typical uses of such heaters include area (e.g., ceiling or floor) heaters, pizza box heaters, thin heaters for pipes, wide heaters for under desks and tables, spaced heaters for greenhouse plant use, and military thermal signature targets.

There are, however, some applications in which the heater design disclosed in the aforementioned patents and patent applications is not entirely satisfactory. For example, in heaters in which the heating area is very small, it is difficult to confine heating to the heated area and there may be too little semi-conductor free area to insure secure tie-down of the metal conductors. Using the copper strip structure of the above-mentioned patents, it is similarly difficult to provide an extremely flexible heater, as is desired for use in, for example, an electric blanket; and the structure of those patents also effectively limits the locations at which electrical contacts may be connected to the heater.

SUMMARY OF THE INVENTION

According to the present invention, a conductive ink (e.g., conductive particles, such as silver, carried in a liquid binder) is deposited onto the semi-conductor pattern. It has been found that the conductive ink migrates into the semi-conductor material, provides a superior electrical contact between the conductor (e.g., the silver ink) and the already deposited semi-conductor material (e.g., the colloidal graphite ink), and essentially eliminates interface resistance.

In some preferred embodiments, the semi-conductor material is printed on one side of a woven cloth substrate and, after the semi-conductor material has been cured, the conductive ink is printed on the other side.

According to the present invention, the conductive ink should be deposited onto the semi-conductor material; the desired low-interface resistance contact cannot be assured if the conductive ink is deposited first.

DESCRIPTION OF THE PREFERRED EMBODIMENTS

Figure 1:
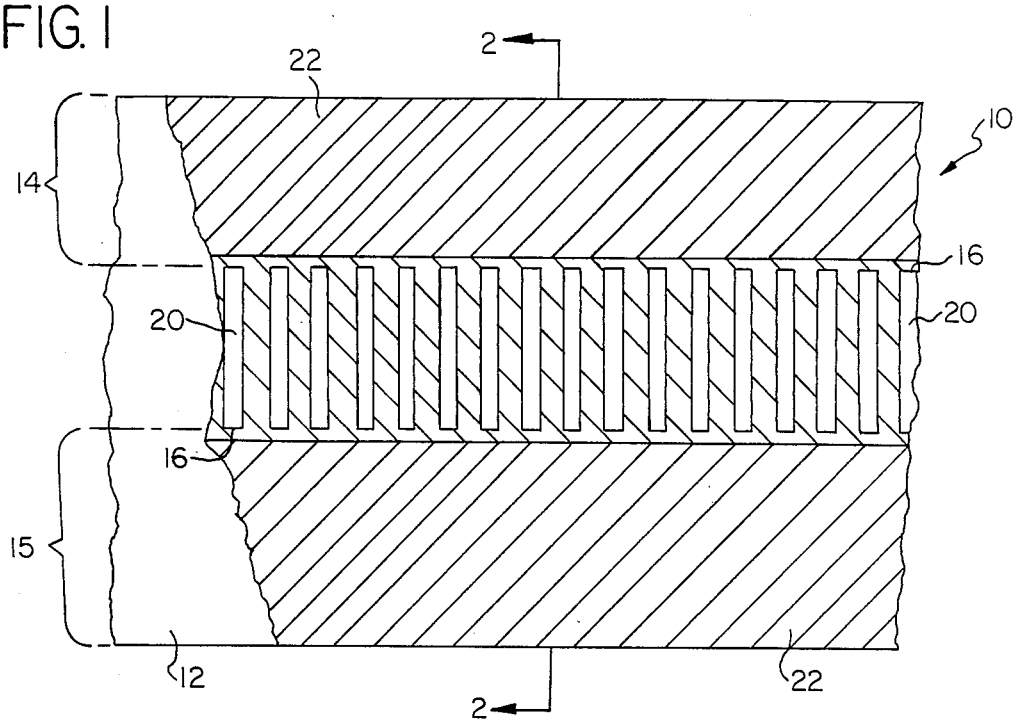
FIGS. 1, 3 and 4 are plan views of heaters embodying the present invention.

Referring now to FIG. 1 there is shown a heater, generally designated 10, including a substrate 12 on the top side of which has been printed, typically by silk-screening, a semi-conductive pattern of colloidal graphite. Substrate 12 is plastic, although paper, cloth or another suitable electrically insulating material may be employed also.

As shown in FIG. 1, the graphite pattern printed on top of substrate 12 includes a pair of parallel, spaced-apart, longitudinally-extending contact portions or stripes 14, 15, about 0.36 in. (about 0.9 cm.) and 0.47 in. (about 1.2 cm.) wide, respectively, and spaced apart approximately 0.78 in. (about 2 cm) from each other. The graphite pattern also includes a plurality of substantially identical bars 18 extending generally perpendicularly between stripes 14, 15. Each bar is about 0.060 in. (about 0.15 cm.) wide (measured longitudinally of stripes 14, 15), and an unprinted area 20 (i.e., an area of substrate 12 that is free from semi-conductor material) about 0.040 in. (about 0.1 cm) wide is provided between adjacent bars.

In heater 10 (and in the other preferred embodiments described hereinafter) the material forming the semi-conductor pattern is a semi-conductive graphite ink (i.e., a mixture of colloidal graphite particles in a binder) and is printed on the substrate 12 at a substantially uniform thickness (typically about 0.00125 cm. or 0.0005 in. for the portion of the pattern forming bars 18, and due to processing, slightly thicker for the portions of the pattern forming stripes 14, 15) using a conventional silk-screen process, and is then cured, typically in a conventional manner, typically at a temperature higher than what the heater will reach in use. Inks of the general type used are commercially available from, e.g., Acheson Colloids Co. of Port Huron, Mich. (Graphite Resistors for Silk Screening) and DuPont Electronic Materials Photo Products Department, Wilmington, Del. (4200 Series Polymer Resistors, Carbon and Graphite Base). A similar product, Polymer Resistant Thick Films, is sold by Methode Development Co. of Chicago, Ill. Semiconductor materials of the type used in the present invention are also discussed in the literature; see for example U.S. Pat. Nos. 2,282,832; 2,473,183; 2,559,077; and 3,239,403.

Figure 2:
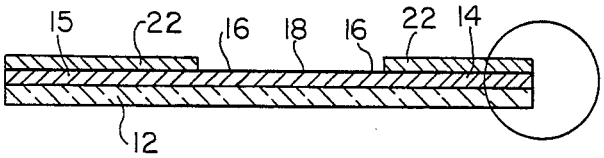
FIGS. 2 and 5 are sections, in which thicknesses have been enlarged for purposes of clarity, of, respectively, the heaters of FIGS. 1 and 4.
Figure 2A:
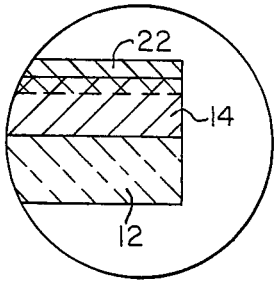

A thin (e.g., 0.001 inch or less thick above the surface on which it is deposited) layer 22 of a highly conductive ink (e.g., a silver ink comprising a mixture of silver particles in a binder) is deposited (e.g., by painting or printing) on top of stripes 14, 15 and is then cured, again in a conventional manner. Conductive inks of the type used are commercially available from, e.g., Amicon Corporation of Lexington, Mass. (C-225 Series Conductive Thermoplastic PTF Inks), Acheson Colloids Co. of Port Huron, Mich. (Electrodag 5910 Silver Filled Adhesive and Electrodag 427SS Silver Based Polymer Thick Film Ink), and A.I. Technology, Inc. of Princeton, N.J. (PTF 5208 and PTF 5205M Conductive Polymar Thick Film Ink). As shown, each layer 22 extends almost the full width of the associated stripe 14, 15. A narrow (e.g., about 0.020 inches or about 0.05 cm. wide) portion 16 along the inside edge of each stripe 14, 15 is left exposed to insure that, in the silver ink printing process, no portion of the bars 18 will be covered with the conductive ink. As indicated in FIG. 2A, the silver ink layers 22 migrate into the underlying semi-conductor material stripes 14, 15, thus effectively eliminating interface resistance between the conductive silver ink and the semi-conductive material. In FIG. 2A, the silver ink layer 22 is indicated as migrating only a fraction of the thickness of the stripe or bar. In practice, the silver ink typically migrates completely through the underlying colloidal graphite layer.

The resistivity of a thin silver ink layer such as layers 22 is considerably greater than that of a copper strip conductor of the type described in aforementioned U.S. Pat. Nos. 4,485,297, 4,523,085 and 4,542,285. For example, the resistance of an 0.001 inch thick silver layer of the Amicon C-225 Series ink is about ¼ ohm per square, which means that a ¼ inch wide, about 0.001 inch thick, layer of silver ink will have a resistance of about 12 ohms per foot; by way of contrast, a ¼ inch wide by 3 mil copper strip has a resistance of about 0.01 ohms per foot. Because of the much greater resistance of the silver layers, the present invention is most useful in relatively short or flexible heaters in which the copper strip conductor structure of the above-mentioned patents may present difficulties.

The conductivity of silver layers 22 is, however, much greater than that of semi-conductor stripes 14, 15 and bars 18, which, typically, have a resistance of 150–300 ohms per square. This difference, coupled with the lack of significant interface resistance between the silver layers 20 and the stripes 14, 15 into which the silver layer migrates, insures that the stripe/conductor portion of the heater will run "cold" (e.g., at or only slightly above room temperature) when power is applied to the heater and the bar area between stripes is heated (e.g., up to 250° F.) This makes it possible to construct extremely small and precisely defined heaters, for example heaters in which the heating area between stripes 14, 15 is only 0.030–0.050 inches wide.

As will be evident, a heater may be cut to length so that it contains any desired number of bars 18. In the illustrated embodiment, a heater 0.400 inches long would be cut to contain four repeats of bars 18 and spaces 20, and the transverse cuts could be made anywhere in the heater. If it were desired to provide a heater the length of which was not equal to an integral number of times the 0.100 inch center-to-center distance between adjacent bars 18, the width of the bars 18 or spaces 20 may be varied so that a whole number of bar-space repeats would occur in the desired length; each bar and space should have a minimum width of not less than about 0.020 inches. For example, if a heater 0.350 inches square is desired, the semi-conductor pattern may be printed so that stripes 14, 15 are 0.350 in. apart, the center-to-center bar spacing is 0.070 in. (0.350 in. divided by 5), and, the bars and spaces are, respectively, 0.045 in. and 0.025 in. wide. Similarly, a 0.360 inch long heater could include, for example, bars 0.060 in. wide spaced 0.030 inches apart, or bars 0.040 inches wide spaced 0.020 apart. Once the desired bar/space pattern is established, the desired watt output can readily be obtained by varying the resistivity of the colloidal graphite ink used and/or the thickness at which the semi-conductor pattern is printed.

Figure 3:
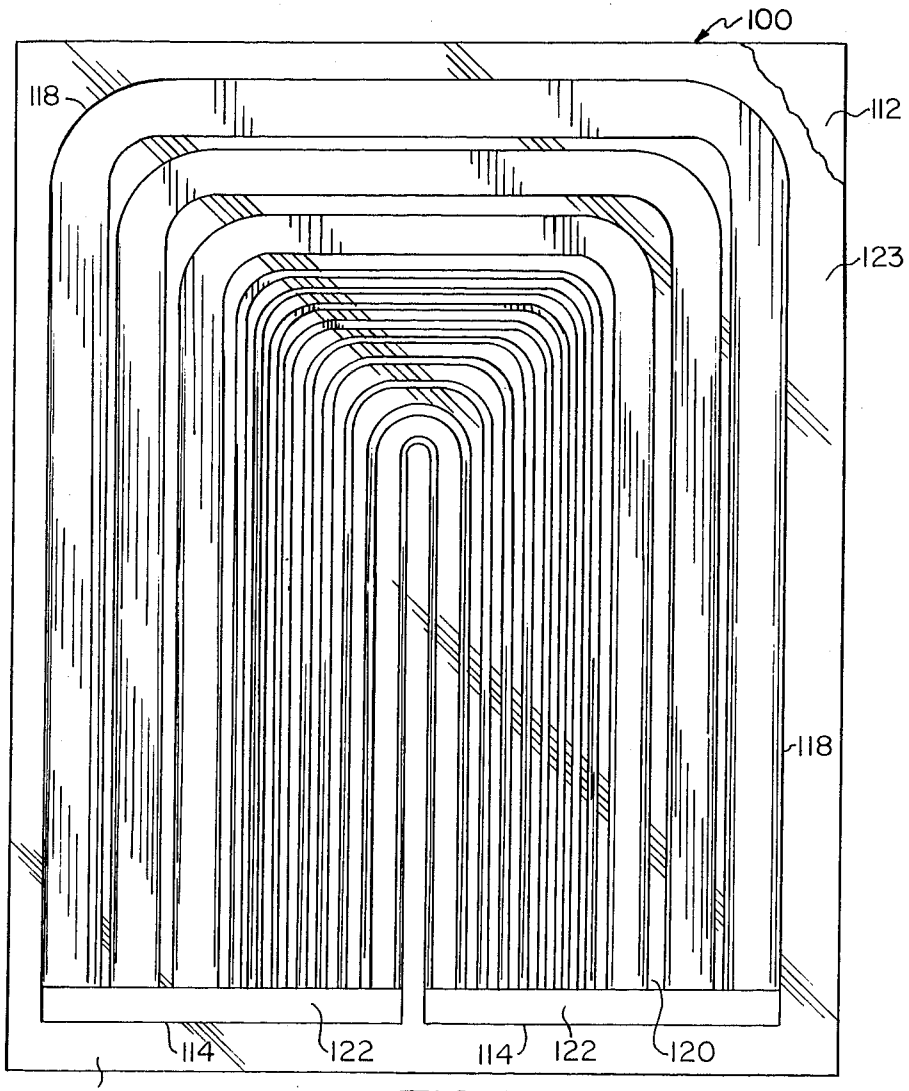

Reference is now made to FIG. 3 which illustrates another heater, generally designated 100, embodying the invention.

Heater 100 includes plastic substrate 112 on the top of which has been printed a graphite pattern including a pair of parallel conductor contact portions or stripes 114, printed end-to-end with an approximately ¼ inch (0.63 cm.) space between them. Each stripe is about ⅜ inch (0.95 cm.) wide and 3½ inches (8.9 cm.) long.

The graphite pattern includes also a plurality (as shown, twelve) of spaced, generally "U" shaped semi-conductor heating portions or bars 118 extending between stripes 114. One end of each bar 18 is connected to each of stripes 114 and unprinted areas or "white space" 120 (i.e., areas free from semi-conductor material) are provided between bars 118 and along the outside edges of the semi-conductor pattern. As shown, each individual bar 118 is of substantially constant width along its length, although the widths of different bars range between about 1/16 inch and ⅝ inch.

A thin (e.g., about 0.001 inch thick) layer 122 of silver ink is printed on top of stripes 114 (again, after the semi-conductor pattern has been dried). Each layer 122 is about ¼ inch wide and extends substantially the full length of the associated stripe 114.

In the heater of FIG. 3, the graphite pattern (stripes 114 and bars 118) is printed on the upper face of substrate 112, and the graphite pattern and silver layers 122 are hermetically sealed between substrate 112 and an overlying thin, transparent plastic sheet 123. As discussed in aforementioned U.S. Pat. No. 4,485,297, sheet 123 is a colamination of a 0.005 cm. (0.002 in.) thick polyester ("Mylar") dielectric insulator and a 0.007 cm. (0.003 in.) thick adhesive binder, typically polyethylene. Plastic adheres poorly to graphite, but the polyethylene layer of sheet 123 bonds well to substrate 112. In the illustrated embodiment, sheet 123 is heat sealed to the uncoated areas 120 outside stripes 114 and bars 118 and between adjacent bars 118. Sheet 123 prevents flaking or delamination of the silver layers 120 when the heater 110 is bent or flexed.

Heater 100 may be connected to a voltage source (not shown) using a crimp-on connector of the type described in the aforementioned patents. Such connectors pierce plastic sheet 123 and engage a silver layer 122.

Figure 5:
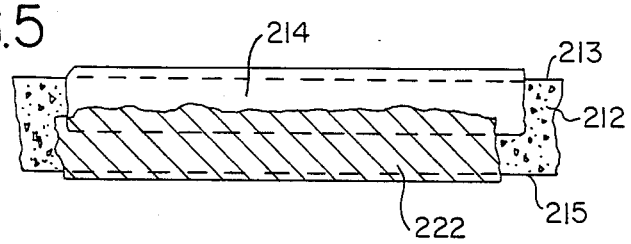
Figure 4:
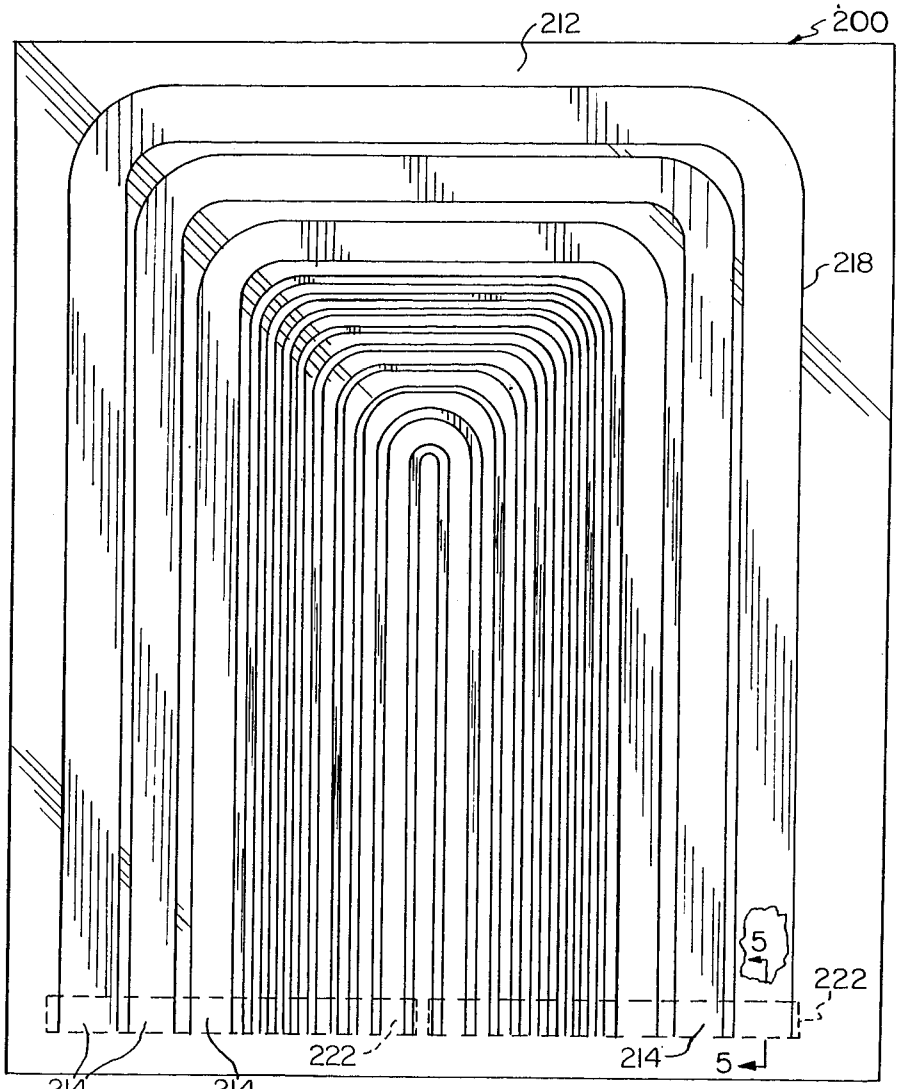

FIGS. 4 and 5 illustrate a heater 200 in which the graphite semi-conductor pattern is printed on one side of a closely woven fabric (e.g., polyester or cotton) substrate 212 and the conductive ink stripes 220 are printed on the other side.

The graphite semi-conductor pattern includes a plurality of U-shaped bars 218, essentially identical except in overall length to bars 118 of the heater of FIG. 3. The graphite semi-conductor pattern of heater 200 includes no semi-conductor "stripes" (which in the previously-discussed embodiments act, in effect, as "bus bars" connecting the ends of different bars 18 and 118 to each other); and the overall length of each bar 218 is about ¾ inch (about 1.8 cm.) more than the length of the corresponding bar 118 in FIG. 3 (one-half of the extra length being added at each end of a bar 218). The added length portions, designated 214, have the same overall width and thickness as the rest of the respective bar of which they are a part, and provide discrete conductor contact portions, one at each end of each bar 218.

As shown schematically in FIG. 5, the semi-conductor pattern is printed on the top side 213 of cloth substrate 212, penetrates into the cloth, and flows into the spaces surrounding the fibers of the woven material, through substantially the entire thickness of the cloth.

After the printed semi-conductor pattern has dried, two strips 222 of silver ink are painted or printed on the other side 215 of substrate 212, i.e., on the bottom of the fabric as shown in FIGS. 4 and 5). The amount of ink used in each strip is such that the ink, if deposited on a liquid impervious-substrate, would be about 0.001 inch thick.

Each of silver ink strips 222 is about ¼ inch wide and 3½ inches long, and is positioned to register with (and thus overlie and electrically connect to) the extra length portions 214 at a respective end of each of bars 218 (and, as will be seen, the semi-conductor free fabric between adjacent end portions 214). The ink forming strips 222 penetrates into the cloth substrate 212 and, as previously indicated, migrates into the semi-conductor material of the already-deposited extra length conductor contact portions 214.

Because both the semi-conductor graphite ink and highly conductive silver ink penetrate into cloth substrate 212, (each penetrates all or substantially all the way through the cloth), the overall thickness of heater 200 very closely approximates the thickness of the fabric substrate itself. The resulting heater is extremely flexible, and the fact that most of the semi-conductor and conductive ink is within the cloth fibre matrix greatly reduces the risk that either the semi-conductor bars or conductive silver ink strips will fail when the heater is flexed or bent. Heater 200, thus, is especially suited for use in applications in which considerable flexure is expected, e.g., in an electric blanket or heat automobile seats. In applications where the additional bending strain resulting from added thickness is less important, the semi-conductor pattern and conductive ink may both be printed on the same side of the substrate.

Heater 200 may be connected to a voltage source (typically, less than 30 volts when the heater is used in applications in which its electrical elements are not sealed within insulation) by thin (3 mil), square (1"×1") copper connectors each of which is bonded to a respective silver layer 222 by a conventional conductive adhesive. Lead wires are, in turn, soldered to the copper connectors.

Other embodiments will be within the scope of the following claims.

What is claimed is:

1. The process of making an electrical heating device comprising:

(a) providing a woven fabric;

(b) depositing a semi-conductor ink onto said fabric to form a semi-conductor pattern including a pair of spaced-apart conductor contact portions and a heating portion extending between and electrically connected to said conductor contact portions, said semi-conductor pattern being deposited on one side of and penetrating into the thickness of said fabric; and, (c) thereafter depositing a conductive ink in registration with each of said conductor contact portions such that said conductive ink electrically engages said conductor contact portions, said conductive ink being deposited on the other side of and penetrating into the thickness of said fabric and migrating into said semi-conductor pattern.

2. The process of claim 1 including the step of curing said semi-conductor ink of said pattern prior to depositing said conductive ink.

3. The process of claim 1 wherein said semi-conductor ink comprises colloidal graphite particles in a binder.

4. The process of claim 1 wherein conductive ink comprises silver particles in a binder.

5. The process of claim 1 wherein said inks are deposited by screen printing.

6. The process of claim 1 including the steps of depositing said conductive ink onto one or more predetermined areas, one portion of each said area being in registration with said semi-conductor pattern and another portion of each of said area being in registration with an area of said substrate on which no semi-conductor ink has been deposited.

7. The process of making an electrical heating device comprising:

(a) providing a substrate having at least one electrically insulating surface;

(b) depositing a semi-conductor ink onto said electrically insulating surface to form a semi-conductor pattern including a pair of spaced-apart conductor contact portions and a heating portion extending between and electrically connected to said conductor contact portions; and, (c) thereafter depositing a conductive ink onto one or more predetermined areas, one portion of each said area being in registration with said semi-conductor pattern and another portion of each said area being in registration with an area of said substrate on which no semi-conductor ink has been deposited, said substrate comprising woven fabric, said semi-conductor pattern being printed on one side of and penetrating into said fabric, and said conductive ink being thereafter printed on the other side of and penetrates into said fabric and electrically engaging and migrating into said conductor portion.

8. The process of making an electrical heating device comprising:

(a) providing a fabric;

(b) depositing a semi-conductor material on one side of said fabric such that said conductive material forms a semi-conductor pattern and penetrates into said fabric; and (c) thereafter depositing a conductive material on the other side of said fabric such that said conductive material penetrates into the thickness of said fabric and into electrical contact with said semi-conductor pattern.

* * * * *